US010338510B2

(12) United States Patent
Takahashi

(10) Patent No.: US 10,338,510 B2
(45) Date of Patent: Jul. 2, 2019

(54) IMAGE FORMING APPARATUS WITH HEAT ACCUMULATOR

(71) Applicant: Konica Minolta, Inc., Chiyoda-ku, Tokyo (JP)

(72) Inventor: Koji Takahashi, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/953,941

(22) Filed: Apr. 16, 2018

(65) Prior Publication Data

US 2018/0307169 A1 Oct. 25, 2018

(30) Foreign Application Priority Data

Apr. 19, 2017 (JP) ..... 2017-082508

(51) Int. Cl.
*G03G 15/20* (2006.01)
*G03G 15/00* (2006.01)

(52) U.S. Cl.
CPC ..... *G03G 15/5029* (2013.01); *G03G 15/2028* (2013.01); *G03G 15/2064* (2013.01); *G03G 15/6588* (2013.01)

(58) Field of Classification Search
CPC ..... G03G 15/205; G03G 15/2028; G03G 15/5029; G03G 15/6582; G03G 15/6588; G03G 2215/00789; G03G 15/2064
See application file for complete search history.

(56) References Cited

U.S. PATENT DOCUMENTS 7,992,617 B1 * 8/2011 Lee ..... B32B 37/0053 156/499
2005/0028937 A1 * 2/2005 McKay ..... B41J 11/46 156/540
2006/0013623 A1 * 1/2006 Kagawa ..... G03G 15/2053 399/328
2016/0257100 A1 * 9/2016 Tachibana ..... G03G 15/6588

FOREIGN PATENT DOCUMENTS

JP H04178674 A 6/1992
JP 2015025908 A 2/2015

* cited by examiner

*Primary Examiner* — Sophia S Chen
(74) *Attorney, Agent, or Firm* — Cantor Colburn LLP

(57) ABSTRACT

An image forming apparatus includes: a fixing device that forms a fixing nip by bringing a pressure member into pressure contact with a peripheral surface of a heating rotator and fixes an unfixed toner image; an acceptor that accepts a specified laminate processing mode for performing laminate processing by feeding a laminate; and a hardware processor that controls a heating rotator to idle for a predetermined time and then controls to perform the laminate processing, wherein a heat accumulating member provided to be capable of contacting with and separating from an outer peripheral surface of the pressure member and a pressure contact/separation mechanism are further included, and the hardware processor performs control to idle the heating rotator for a predetermined time in a state where the heat accumulating member is brought into pressure contact with the pressure member to accumulate heat in the heat accumulating member.

14 Claims, 9 Drawing Sheets

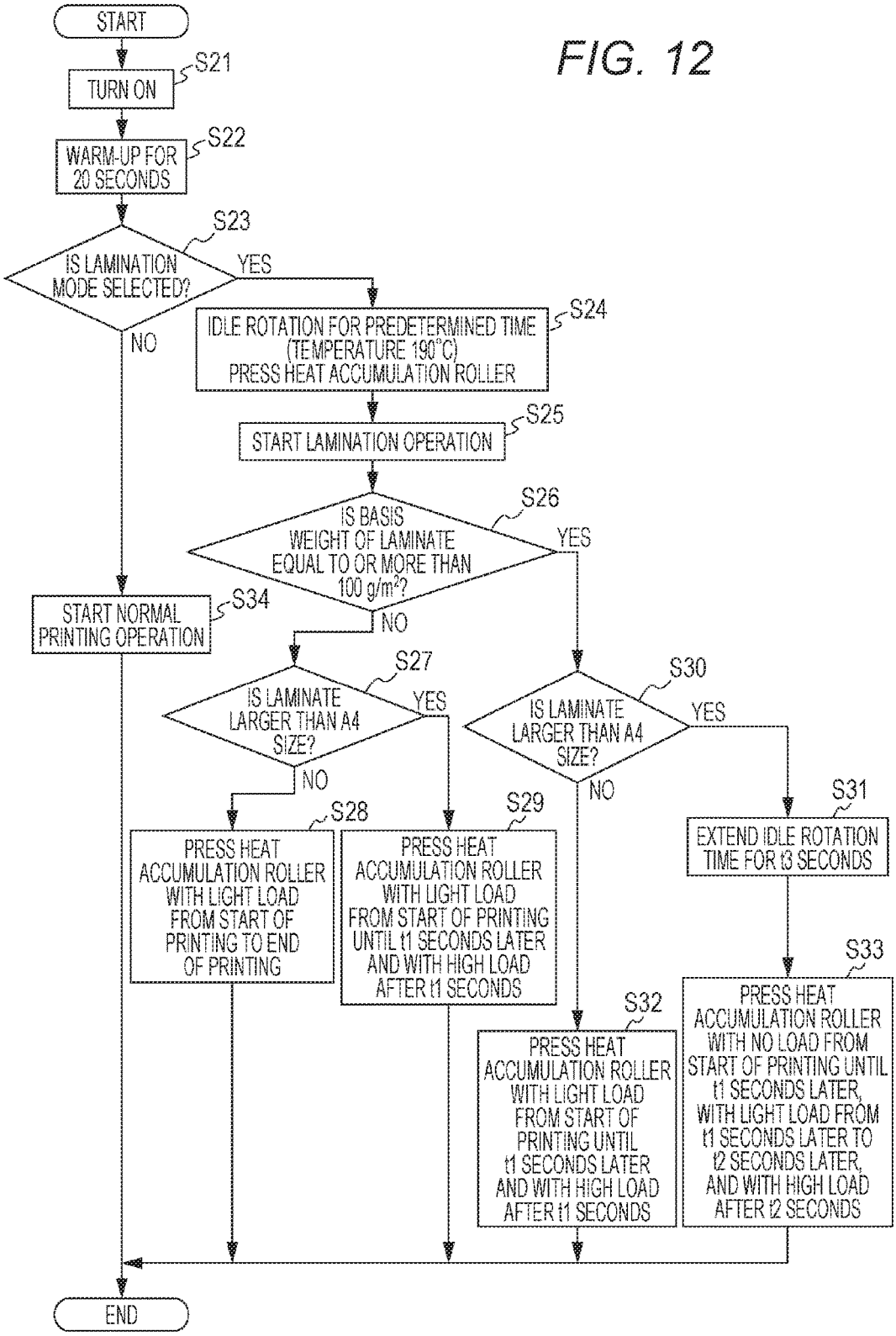
FIG. 12
START
TURN ON
S21
WARM-UP FOR 20 SECONDS
S22
IS LAMINATION MODE SELECTED?
S23
YES
NO
IDLE ROTATION FOR PREDETERMINED TIME (TEMPERATURE 190°C) PRESS HEAT ACCUMULATION ROLLER
S24
START LAMINATION OPERATION
S25
IS BASIS WEIGHT OF LAMINATE EQUAL TO OR MORE THAN 100 g/m²?
S26
YES
NO
START NORMAL PRINTING OPERATION
S34
IS LAMINATE LARGER THAN A4 SIZE?
S27
YES
NO
IS LAMINATE LARGER THAN A4 SIZE?
S30
YES
NO
PRESS HEAT ACCUMULATION ROLLER WITH LIGHT LOAD FROM START OF PRINTING TO END OF PRINTING
S28
PRESS HEAT ACCUMULATION ROLLER WITH LIGHT LOAD FROM START OF PRINTING UNTIL t1 SECONDS LATER AND WITH HIGH LOAD AFTER t1 SECONDS
S29
EXTEND IDLE ROTATION TIME FOR t3 SECONDS
S31
PRESS HEAT ACCUMULATION ROLLER WITH LIGHT LOAD FROM START OF PRINTING UNTIL t1 SECONDS LATER AND WITH HIGH LOAD AFTER t1 SECONDS
S32
PRESS HEAT ACCUMULATION ROLLER WITH NO LOAD FROM START OF PRINTING UNTIL t1 SECONDS LATER, WITH LIGHT LOAD FROM t1 SECONDS LATER TO t2 SECONDS LATER, AND WITH HIGH LOAD AFTER t2 SECONDS
S33
END

IMAGE FORMING APPARATUS WITH HEAT ACCUMULATOR

CROSS-REFERENCE TO RELATED APPLICATION

The present application claims priority under 35 U.S.C. § 119 to Japanese Patent Application No. 2017-082508, filed on Apr. 19, 2017, the entire contents of which are incorporated herein by reference.

BACKGROUND

Technological Field

The present invention relates to an image forming apparatus capable of performing laminating processing using a fixing device, and more particularly, to an image forming apparatus which suppresses generation of wrinkles and warpages of a laminate film by reducing shortage of a heat quantity of a pressure member at the time of the laminate processing.

Description of the Related Art

An image forming apparatus such as a printer and a copying machine includes a fixing device which fixes an unfixed toner image on a sheet with a fixing roller by heating and pressurizing the toner image. An image forming apparatus has been traditionally proposed in which the fixing device has a so-called laminate mode. In the laminate mode, processing can be performed for feeding a laminate sheet having a printed recording medium sandwiched between laminate films (referred to as "film setting sheet" below) and welding the laminate films.

For example, JP 4-178674 A discloses an image forming apparatus in which the temperature of the fixing roller can be set to a plurality of fixing temperatures at the time of the laminate processing because a larger heat quantity than normal unfixed toner image fixing is absorbed by the laminate film and a higher fixing temperature can be selected when the laminate processing is performed.

However, to efficiently heat a printing surface of the recording medium, the fixing device which has achieved power saving includes a heat source on the printing surface and improves thermal conductivity as making a member of the fixing roller have high thermal conductivity. Furthermore, the fixing device decreases the thermal conductivity on the rear surface of the printing surface, that is, a pressure roller as a pressure member as possible and has a structure in which the heat is hardly transmitted to the pressure roller. Such a fixing device has been mainly used recently.

Even if the temperature of the fixing roller is increased as described above, in many cases, the pressure roller facing to the fixing roller does not have a heater to save cost and power. There is a problem in that a difference between temperatures of the printing surface and the rear surface at the time of laminate processing is easily made, an adhesion failure, wrinkles, and warpages are generated, and this causes poor laminate processing.

Therefore, JP 2015-25908 A discloses an image forming apparatus which includes a heat accumulation information acquisitor having a heat accumulation state of the pressure member as an index. The image forming apparatus determines an execution time of idle rotation processing for rotating a heating rotator without feeding a sheet while a fixing nip is formed based on the heat accumulation information indicating the heat accumulation of the pressure member acquired by the heat accumulation information acquisitor and preheats the pressure member by performing the idle rotation processing for the determined time, and then performing the laminate processing. According to JP 2015-25908 A, by performing the idle rotation processing, the heat can be previously accumulated in the pressure member, and the quality of the laminate processing can be improved.

As described above, the pressure member is sufficiently warmed by the idle rotation processing, and a necessary heat quantity can be secured in the laminate processing within a predetermined size and a predetermined basis weight. Furthermore, a difference between the temperatures of two laminate films can be reduced, and the quality of the laminate processing can be maintained.

However, in a case where a sponge layer is adopted as an elastic layer of the pressure member to further improve power saving property, the heat cannot be sufficiently accumulated. There has been a case where it is difficult to stably perform the laminate processing only by performing the idle rotation processing depending on the size and the basis weight of the laminate film.

SUMMARY

An object of the present invention is to provide an image forming apparatus which can perform laminate processing using laminate films having various sizes and basis weights even in a fixing device with a lower thermal capacity and a lower fixing temperature.

To achieve the abovementioned object, according to an aspect of the present invention, an image forming apparatus reflecting one aspect of the present invention comprises: a fixing device that forms a fixing nip by bringing a pressure member having a release layer and an elastic layer on a surface into pressure contact with a peripheral surface of a heating rotator and fixes an unfixed toner image by feeding a recording medium having the unfixed toner image through the fixing nip; an acceptor that accepts a specified laminate processing mode for performing laminate processing by feeding a laminate in which laminate films are laminated on both surfaces of the recording medium through the fixing nip; and a hardware processor that controls a heating rotator to idle for a predetermined time without feeding a sheet while the fixing nip is formed when the laminate processing mode is accepted, and then, controls to perform the laminate processing, wherein a heat accumulating member provided to be capable of contacting with and separating from an outer peripheral surface of the pressure member and a pressure contact/separation mechanism which makes the heat accumulating member have contact with or be separated from the pressure member are further included, and when accepting the laminate processing mode, the hardware processor performs control to idle the heating rotator for a predetermined time in a state where the heat accumulating member is brought into pressure contact with the pressure member by the pressure contact/separation mechanism to accumulate heat in the heat accumulating member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 12 is a processing flowchart of the controller, and an operation corresponding to the size and the basis weight of the laminate film is illustrated.

DETAILED DESCRIPTION OF EMBODIMENTS

Hereinafter, an image forming apparatus according to one or more embodiments of the present invention will be specifically described with reference to the drawings. However, the scope of the invention is not limited to the disclosed embodiments. The image forming apparatus according to the present invention can be implemented with an appropriate modification within a range not changing the gist of the present invention.

Figure 1:
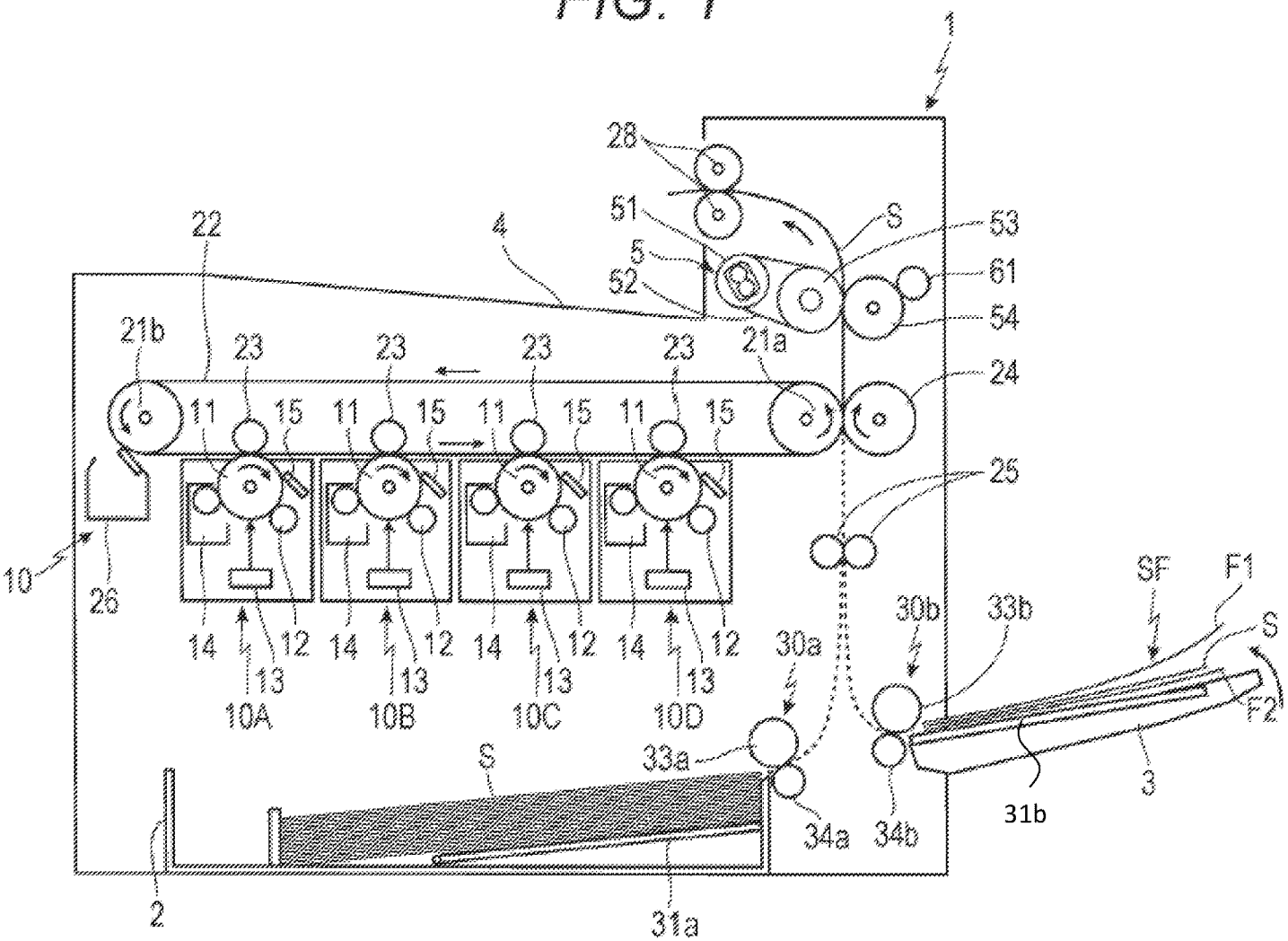
FIG. 1 is an explanatory diagram of an internal configuration of an image forming apparatus according to an embodiment of the present invention.
Figure 2:
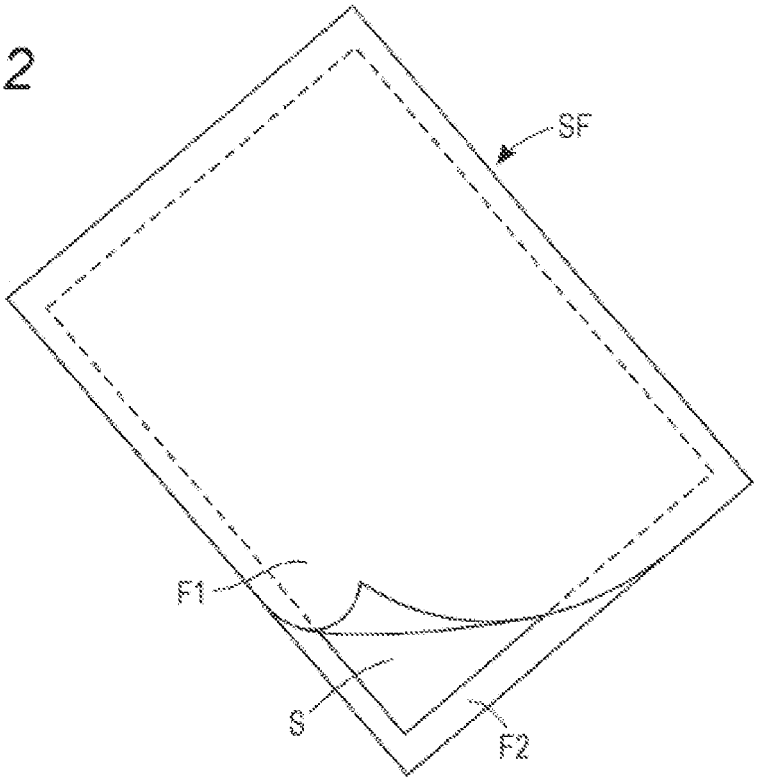
FIG. 2 is a perspective view of a film setting sheet in which a printed recording medium is sandwiched between laminate films.

FIG. 1 is a diagram of an image forming apparatus 1 according to an embodiment of the present invention. The image forming apparatus 1 includes an image processor 10, sheet feeding devices 30*a* and 30*b*, a fixing device 5, and the like. The image forming apparatus 1 can perform a normal printing mode in which an image is formed on a recording medium S and a laminate mode in which laminate processing is performed by the fixing device 5 on a recording medium on which a text, an image, and the like are printed. As illustrated in FIG. 2, a film setting sheet SF is formed by sandwiching a printed recording medium S between a front side film F1 and a back side film F2 of a folded laminate film, and the laminate processing is performed on the film setting sheet SF.

In the image forming apparatus 1, as illustrated in FIG. 1, four imaging cartridges 10A to 10D are mounted as the image processor 10.

Here, in each of the imaging cartridges 10A to 10D, a photoreceptor 11, a charging device 12 for charging a surface of the photoreceptor 11, a latent image forming device 13 for forming an electrostatic latent image on the surface of the photoreceptor 11 by performing exposure on the surface of the charged photoreceptor 11 according to image information, a developing device 14 for supplying a toner to the electrostatic latent image formed on the surface of the photoreceptor 11 to form a toner image, and a first cleaning device 15 for removing residual toner from the surface of the photoreceptor 11 after the toner image formed on the surface of the photoreceptor 11 has been transferred to an intermediate transfer belt 22.

In the present embodiment, a roller charging type charging device 12 is used. However, the kind of the charging device 12 is not particularly limited, and a corona discharging type electrostatic charger, a blade-like charging member, a brush-shaped charging member, or the like may be used.

Furthermore, a plate-like blade is used as the first cleaning device 15. However, a cleaning device is not limited to the blade, and other cleaning members, such as a fixed brush, a rotating brush, or a combination of a plurality of these members can be used. In addition, it is not necessary to provide the cleaning device, and a cleanerless system in which a non-transferred toner on the photoreceptor 11 is collected by the developing device 14 may be adopted.

In the developing device 14 of each of the imaging cartridges 10A to 10D, toners having different colors are housed. For example, toners of black, yellow, magenta, and cyan are housed.

In the image forming apparatus 1, when the printing mode is selected, in each of the imaging cartridges 10A to 10D, the surface of the photoreceptor 11 is charged by the charging device 12, and the surface of each photoreceptor 11 which has been charged in this way is exposed according to the image information by the latent image forming device 13. Then, an electrostatic latent image according to the image information is formed on the surface of each photoreceptor 11, and the toner with each color is supplied from each developing device 14 to the electrostatic latent image formed on the surface of each photoreceptor 11 formed in this way, and the toner image with each color is formed on the surface of each photoreceptor 11.

Next, the toner images with the respective colors formed on the surface of the photoreceptors 11 of the respective imaging cartridges 10A to 10D are sequentially transferred on the intermediate transfer belt 22, which is stretched between a driving roller 21*a* and a rotating roller 21*b* and is rotated and driven, by a primary transfer roller 23 to form a synthesized toner image on the intermediate transfer belt 22 and guide the toner image formed in this way at a position facing to a secondary transfer roller 24 by the intermediate transfer belt 22. Whereas, the toner remaining on the surface of each photoreceptor 11 after the transfer is removed from the surface of each photoreceptor 11 by the corresponding first cleaning device 15.

In the image forming apparatus 1, a plurality of recording media S housed in a sheet feeding cassette 2 provided in the lower portion of the image forming apparatus 1 is fed by the corresponding sheet feeding device 30*a* one by one, and recording medium stacked on an openable and closable manual feed tray 3 provided on the side of the image forming apparatus 1 is fed by the corresponding sheet feeding device 30*b* one by one. The single recording medium S which has been fed is guided to timing rollers 25.

The sheet feeding device 30*a* of the sheet feeding cassette 2 includes a first sheet feeding roller 33*a* and a first separating roller 34*a* and feeds the recording media S stacked on a sheet placing plate 31*a* in the sheet feeding cassette 2 to the timing rollers 25 one by one.

On the other hand, the sheet feeding device 30*b* of the manual feed tray 3 includes a second sheet feeding roller 33*b* and a second separating roller 34*b* and feeds the recording media S stacked on the manual feed tray 3 to the timing rollers 25 one by one.

The recording medium S guided to the timing rollers 25 is guided by the timing rollers 25 to a position between the intermediate transfer belt 22 and the secondary transfer roller 24 at an appropriate timing.

Then, the toner image formed on the intermediate transfer belt 22 is transferred on the recording medium S by the secondary transfer roller 24. Whereas, the toner which is not transferred to the recording medium S and remains on the intermediate transfer belt 22 is removed from the intermediate transfer belt 22 by a second cleaning device 26.

Subsequently, the recording medium S on which the toner image has been transferred is guided to the fixing device 5, and the toner image which is transferred on the recording medium S and is not fixed yet is fixed to the recording medium S by the fixing device 5. After that, the recording medium S on which the toner image has been fixed is guided to a sheet discharging roller 28, and the sheet discharging roller 28 discharges the recording medium S on which the toner image has been fixed on a sheet discharging tray 4.

The image forming apparatus 1 can perform laminate processing using the manual feed tray 3. A user places the film setting sheet SF on the manual feed tray 3 and instructs a job for performing the laminate processing via an operation panel which is not shown. The printed recording medium S to be laminated is sandwiched and laminated between the front side film F1 and the back side film F2 of the folded laminate film in the film setting sheet SF. When the laminate processing is selected, control is performed so as not to form the toner images by the respective imaging cartridges 10A to 10D and to rotate and drive the intermediate transfer belt 22. The film setting sheet SF placed on a sheet placing plate 31*b* of the manual feed tray 3 is supplied from the second sheet feeding roller 33*b* and the second separating roller 34*b*, and via the timing roller 25, passing between the intermediate transfer belt 22 and the secondary transfer roller 24, and transmitted to the fixing device 5 to be described later. Then, the film setting sheet SF is heated and pressed by the fixing device 5, and accordingly, the front side film F1 and the back side film F2 sandwiching the recording medium S are welded, and the laminate processing is performed.

Figure 3:
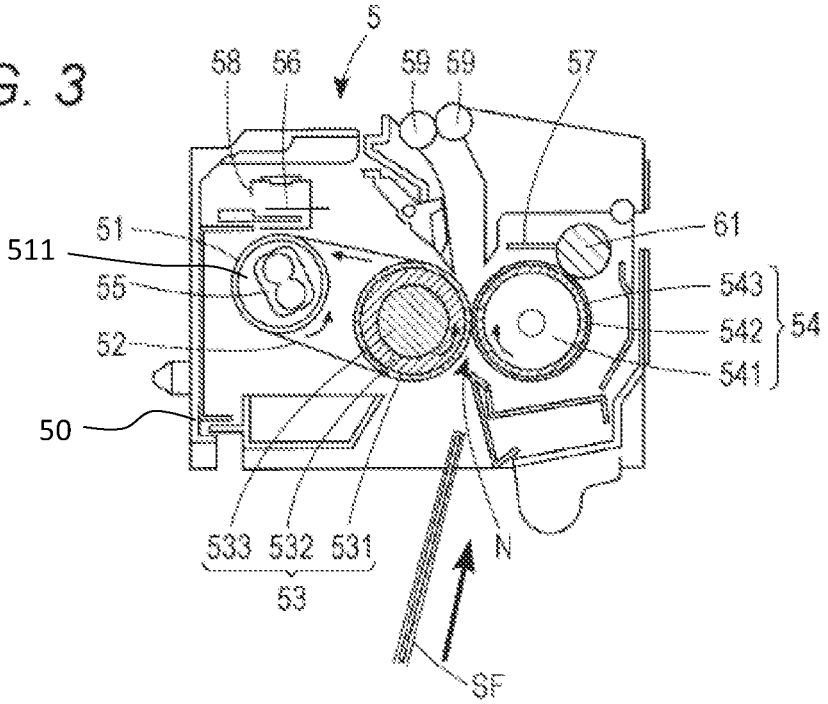
FIG. 3 is a cross-sectional diagram of a main part of a configuration of a fixing device used for the image forming apparatus according to the embodiment of the present invention.

The fixing device 5 used in the present embodiment will be described with reference to FIG. 3. FIG. 3 is a schematic cross-sectional diagram of a main part of the fixing device 5.

As illustrated in FIG. 3, the fixing device 5 includes a heating roller 51, a fixing belt 52, a fixing roller 53, a pressure roller 54, a sheet discharging roller 59, a heat accumulating roller 61 as a heat accumulating member, and the like. The heating roller 51, the fixing belt 52, and the fixing roller 53 form a heating rotator.

The heating roller 51 is made of aluminum, has an outer diameter of, for example, 25 mm. A thickness of a cylindrical core bar 511 is 0.6 mm, and a fluororesin layer having a thickness of 10 μm is laminated on the outer surface of the core bar 511. A heater 55 is inserted in the heating roller 51 along the axial direction.

The fixing belt 52 is stretched around the heating roller 51 and the fixing roller 53. The pressure roller 54 is pressed against the fixing roller 53 via the fixing belt 52 by a spring and the like which is not shown, and a fixing nip N is formed between the fixing belt 52 and the pressure roller 54. In the present embodiment, a nip load is 500 N.

In the fixing belt 52, a silicone rubber layer having a thickness of 150 μm and a fluororesin layer having a thickness of 30 μm are laminated on an outer surface of a polyimide base layer having a thickness of 170 μm.

The outer diameter of the fixing roller 53 is, for example, 30 mm, and the diameter of a solid core bar 533 is 18 mm. On the outer surface of the core bar, a silicone rubber layer 532 having a thickness of six mm and a sponge layer 531 having a thickness of two mm are laminated as heat insulating layers. The fixing roller 53 has the heat insulating structure described above.

The pressure roller 54 is made of aluminum, and has the outer diameter of, for example, 30 mm. A thickness of a cylindrical core bar 541 is two mm. On the outer surface of the core bar 541, an elastic layer 542 having a thickness of two mm and a release layer 543 having a thickness of 30 μm are laminated. The pressure roller 54 has low thermal conductivity and low thermal capacity, and a foam member having thermal conductivity of equal to or less than 0.2 W/mk is used.

Figure 9:
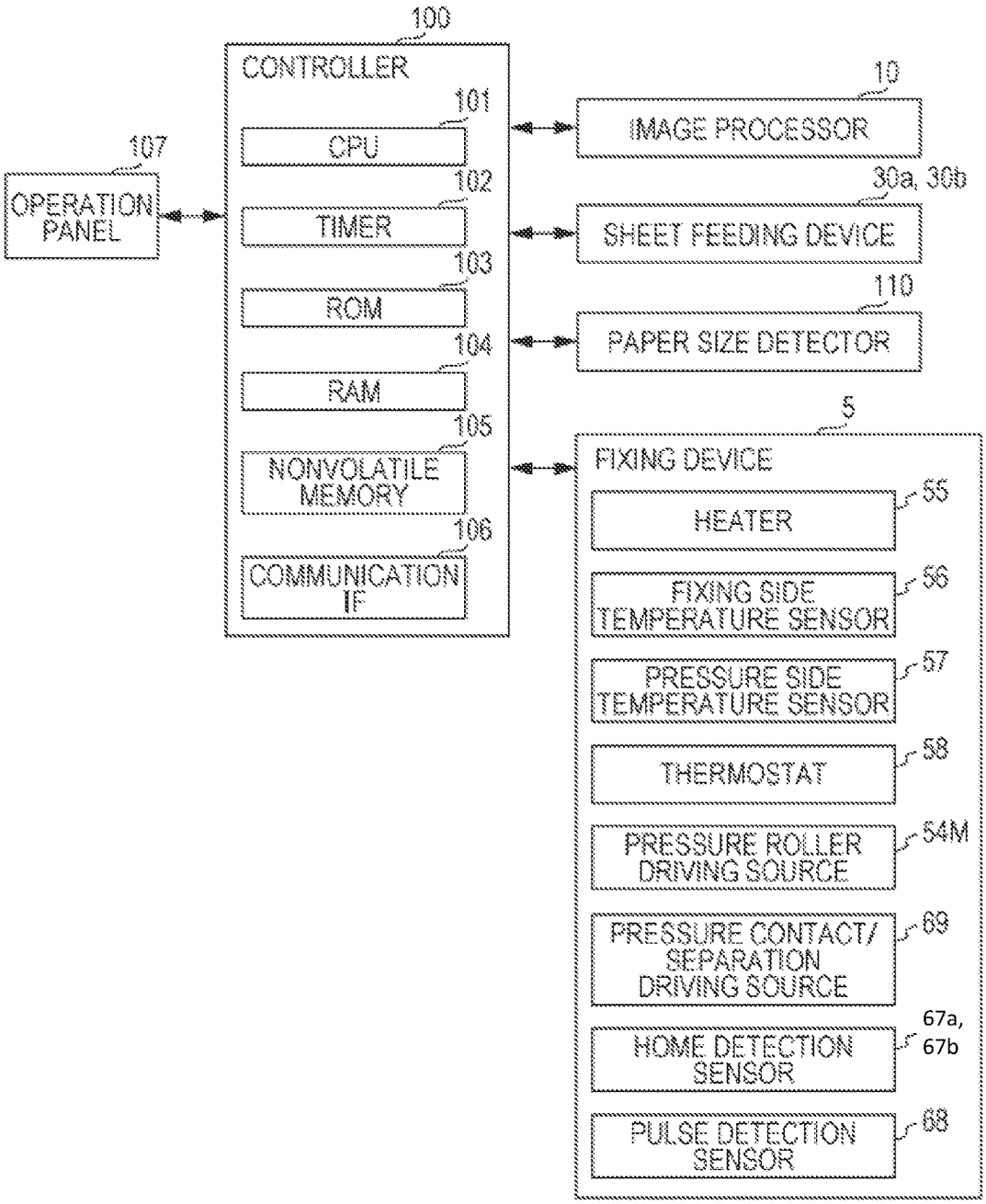
FIG. 9 is a block diagram of a controller and peripheral members of the image forming apparatus according to the embodiment of the present invention.

Both ends of the heating roller 51, the fixing roller 53, and the pressure roller 54 in the axial directions are rotatably supported by a frame (not shown) via a bearing member and the like, and the pressure roller 54 is rotated and driven in a direction of an arrow in FIG. 9 by a driving force from a pressure roller driving source 54M (refer to FIG. 9). The pressure roller driving source 54M is, for example, a DC motor.

A system speed in the present embodiment can be switched between, for example, 110 mm/sec and 55 mm/sec. As will be described later, the controller 100 controls the pressure roller driving source 54M to switch a peripheral speed of the surface of the pressure roller 54 between, for example, 110 mm/sec and 55 mm/sec. According to the rotation of the pressure roller 54, the fixing belt 52, the heating roller 51, and the fixing roller 53 are driven to rotate in the direction of the arrow in FIG. 3, and heat generated from the heater 55 is transmitted to the heating roller 51, the fixing belt 52, the fixing roller 53, and the pressure roller 54 so that temperatures of the fixing belt 52, the pressure roller 54, and the like are increased. In the present invention, as will be described later, in a case where the heat accumulating roller 61 as a heat accumulating member is brought into pressure contact with the pressure roller 54, the heat accumulating roller 61 is rotated together with the rotation of the pressure roller 54, and the temperature of the heat accumulating roller 61 is increased.

The heater 55 is a halogen heater, and the controller 100 controls on/off of the heater 55. The heat of the heater 55 is transmitted to the fixing belt 52 via the heating roller 51, and the fixing belt 52 is heated. The fixing roller 53 is slightly warmed by the heat from the fixing belt 52. However, with the heat insulating structure described above, thermal conduction is suppressed, and a heat loss is reduced.

Each of the fixing side temperature sensor 56 and the pressure side temperature sensor 57 is formed of a non-contact type thermistor. The fixing side temperature sensor 56 detects a surface temperature of the fixing belt 52 and outputs the temperature to the controller 100, and the pressure side temperature sensor 57 detects a surface temperature of the pressure roller 54 and outputs the temperature to the controller 100.

The fixing side temperature sensor 56 is disposed at a position facing the heating roller 51 with the fixing belt 52 and a position, at the substantially center of the surface of the fixing belt 52 in the width direction, where a temperature of a sheet passing region in which the recording medium S and the film setting sheet SF pass through is detected.

The pressure side temperature sensor 57 is disposed at a position, separated from the fixing nip N by a predetermined distance on the downstream side in a rotation direction of the pressure roller 54, where a temperature of a sheet passing region at the substantially center of the surface of the pressure roller 54 in the axial direction is detected.

The fixing side temperature sensor 56 is held at a position separated from the surface of the fixing belt 52 by a predetermined distance (for example, one mm) by a frame provided in a housing 50, and the pressure side temperature sensor 57 is held at a position separated from the surface of the pressure roller 54 by a predetermined distance (for example, two mm) by the frame provided in the housing 50. The kind of each temperature sensor is not limited to these, and other kinds of temperature sensors (for example, contact type thermistor and infrared sensor) can be used.

A thermostat 58 is provided to cut off power to the heater 55 when the fixing belt 52 overheated to a temperature equal to or higher than a certain temperature so as to ensure safety.

Note that, the structure of the fixing device 5 is not limited to the above. When the fixing device has an elastic layer on the heating side, in addition to the pressure side, the present invention can be applied to a roller fixing device only including a pair of rollers and a fixing device having a slider in a belt.

At the time of the laminate processing, the fixing roller 53 is idly rotated for a predetermined time as forming the fixing nip N and without feeding the sheets, and the heat is transmitted from the fixing belt 52 to the pressure roller 54 and is accumulated. The pressure roller 54 has low thermal conductivity, low thermal capacity, and does not sufficiently accumulate the heat. In other words, to perform the idle rotation means a method of accumulating the heat in the pressure roller 54. However, a member for accumulating the heat is the pressure roller 54, and the image on the recording medium S which is a normal paper sheet is fixed. In consideration of this, it is necessary to provide the elastic layer in the viewpoint of ensuring a nip and saving power, and the elastic layer has low thermal conductivity and low thermal capacity. Therefore, the heat accumulation is limited.

Internal thermal accumulation can control a heat accumulation amount only with an idle rotation time and a heating side temperature. Furthermore, since a heat insulating layer is provided on the surface of the pressure roller 54, even when the heat is accumulated over time, heat transfer from the inside is slow. Therefore, when the film setting sheet DF having the laminate film passes through, heat is not sufficiently supplied from the inside, and shortage of the heat quantity caused in the latter half of the laminate processing may cause an adhesion failure of the laminate.

Therefore, in the fixing device 5 used in the present invention, the heat accumulating roller 61 is provided so as to be able to be brought into contact with and separated from the pressure roller 54, and the heat is accumulated in the heat accumulating roller 61, and the accumulated heat is used at the time of laminate processing. That is, in the present invention, to compensate for the heat accumulation amount of the pressure roller 54 which is insufficient only by performing the idle rotation, the heat accumulating roller 61 is provided so as to be able to be brought into contact with and separated from the pressure roller 54, and the heat accumulating roller 61 is brought into pressure contact with the pressure roller 54 at the time of idle rotation, and heat is accumulated in the heat accumulating roller 61. Then, the heat accumulated in the heat accumulating roller 61 is applied to the pressure roller 54 in the latter half of the laminate processing in which the heat quantity lacks to compensate for the lack of the heat quantity.

In addition to the idle rotation time and the heating side temperature, the heat accumulation amount to the heat accumulating roller 61 can be controlled by a pressure contact time and a contact pressure of the heat accumulating roller 61 to the pressure roller 54.

Furthermore, since characteristics of the heat accumulating roller 61 can be freely set, it is possible to adjust the heat accumulation amount by using members having high thermal conductivity and high thermal capacity. Since a surface temperature of the pressure roller 54 made of a heat insulating member is easily increased by heat transfer from the heating side, the heat is easily transmitted to the heat accumulating roller 61 which is brought into contact with the pressure roller 54. Therefore, by using the member having high thermal conductivity, the heat accumulation in the heat accumulating roller 61 is improved.

In the present embodiment, the heat accumulating roller 61 is a roller made of solid aluminum having an outer diameter of 18 mm. On the outer surface of the heat accumulating roller 61, a PFA tube having a thickness of 20 μm is coated or a fluororesin coating having a thickness of 15 μm is applied. The heat accumulating roller 61 has high thermal conductivity and large thermal capacity.

In the present embodiment, a pressure contact/separation mechanism 6 selects one of states of the heat accumulating roller 61, i.e., a high load state where the contact pressure to the pressure roller 54 is high, a light load state where the contact pressure is low, and a state where the heat accumulating roller 61 is separated from the pressure roller 54 according to the laminate processing. In the printing mode, the state of the heat accumulating roller 61 is set to the state where the heat accumulating roller 61 is separated from the pressure roller 54. In the present embodiment, the high load is 70 N in total, and the light load is 20 N in total.

Figure 4:
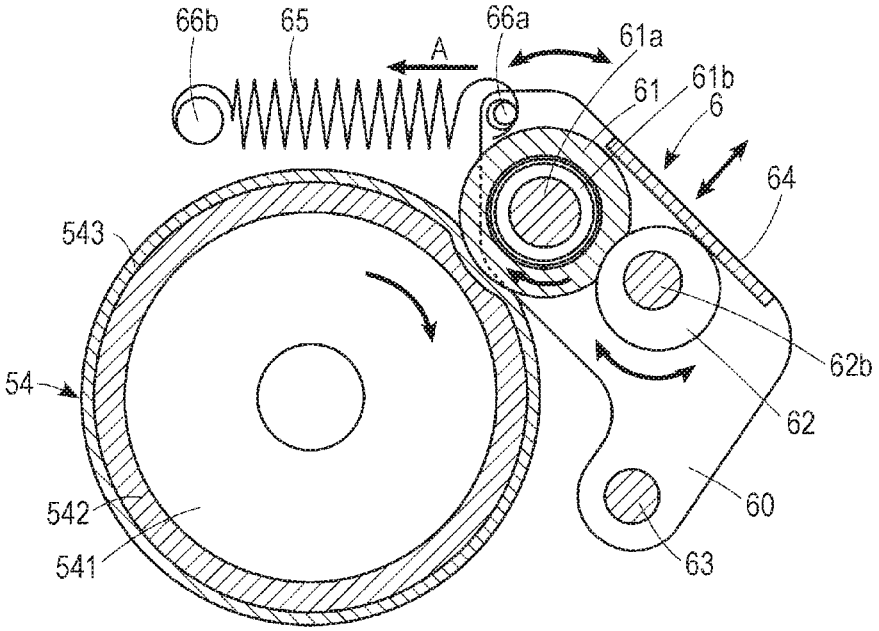
FIG. 4 is an explanatory diagram of a pressure roller and a heat accumulating roller of the fixing device, and a state where the heat accumulating roller is brought into contact with the pressure roller with a high load (high contact pressure) is illustrated.
Figure 5:
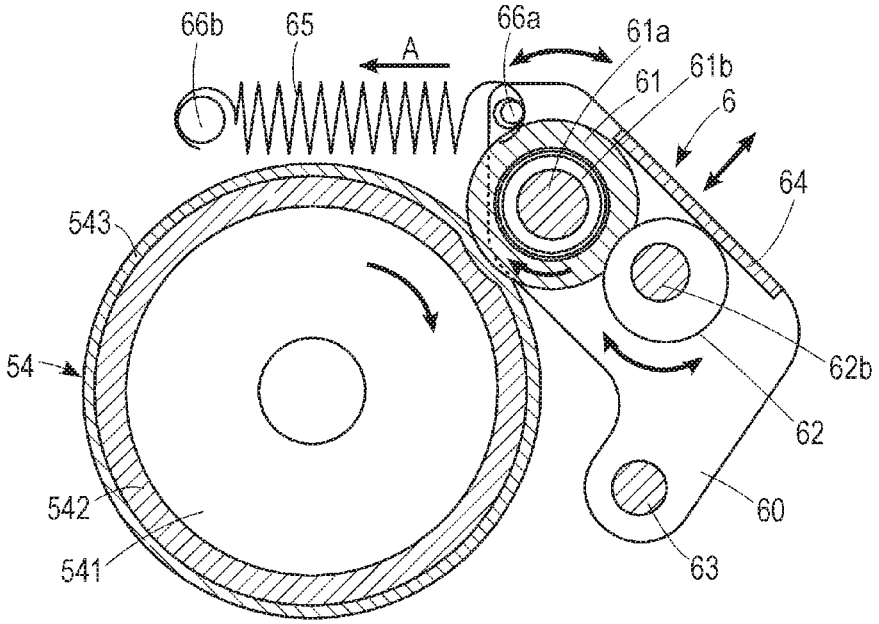
FIG. 5 is an explanatory diagram of the pressure roller and the heat accumulating roller of the fixing device, and a state where the heat accumulating roller is brought into contact with the pressure roller with a low load (low contact pressure) is illustrated.
Figure 6:
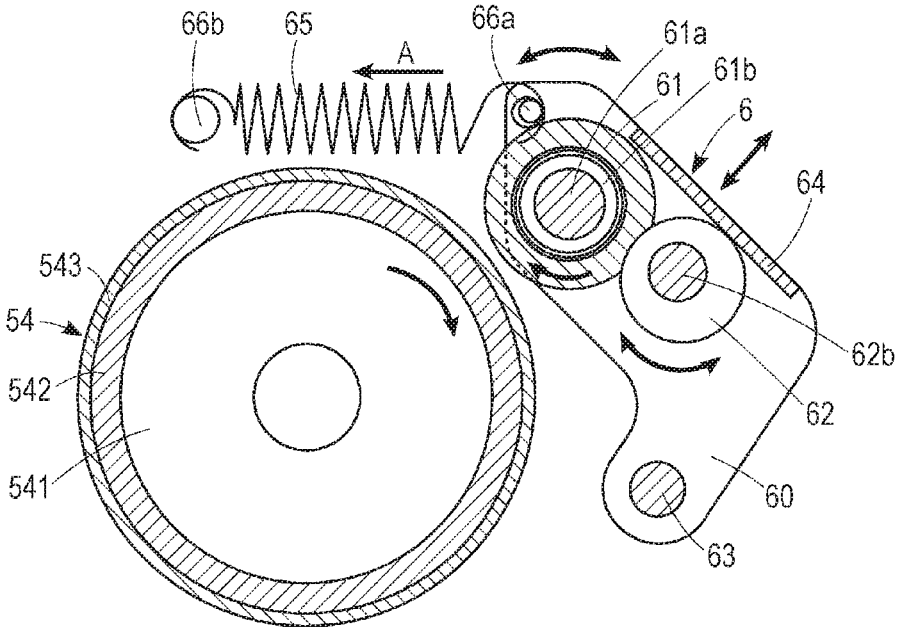
FIG. 6 is an explanatory diagram of the pressure roller and the heat accumulating roller of the fixing device, and a state where the pressure roller and the heat accumulating roller are separated from each other is illustrated.

As illustrated in FIG. 4 to FIG. 6, the heat accumulating roller 61 made of solid aluminum is rotatably attached to a roller shaft 61*a* via a bearing 61*b*. Both ends of the roller shaft 61*a* are fixed to a pair of L-shaped supporting plates 60. The pair of L-shaped supporting plates 60 is rotatably attached to a shaft 63 attached to the frame (not shown). A tension spring 65 is attached between a pin 66*a* provided to the supporting plate 60 and a pin 66*b* attached to the frame (not shown), the tension spring 65 is biased in a direction of an arrow A in FIG. 4 to FIG. 6, the heat accumulating roller 61 is biased toward the pressure roller 54, and the heat accumulating roller 61 is brought into pressure contact with the pressure roller 54 with a predetermined load.

Figure 7:
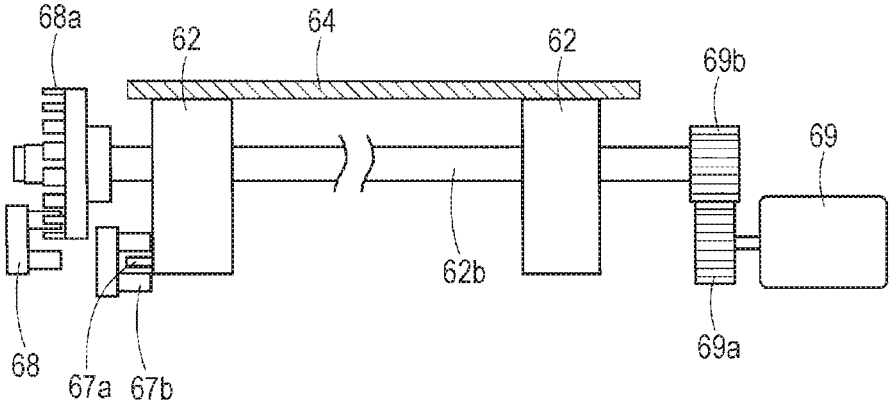
FIG. 7 is a schematic explanatory diagram of a separation cam and an abutting plate as a pressure contact/separation mechanism of the fixing device.

A plate 64 as a cam follower is provided between the pair of supporting plates 60, and a pressure contact/separation cam 62 is brought into contact with the plate 64. As illustrated in FIG. 7, the pressure contact/separation cam 62 is attached to a shaft 62*b*. A gear 69*b* provided at one end of the shaft 62*b* is engaged with a motor gear 69*a* attached to a DC motor 69 as a driving source of the pressure contact/separation mechanism, and the DC motor 69 is driven.

Accordingly, the shaft 62*b* is rotated, and the pressure contact/separation cam 62 is rotated.

As illustrated in FIG. 7, the pressure contact/separation cams 62 are provided at both ends of the shaft 62*b*, and the pressure contact/separation cam 62 is brought into pressure contact with the plate 64 of the supporting plate 60. By rotating the pressure contact/separation cam 62, a state is selected from among states, i.e., a state illustrated in FIG. 4 where the heat accumulating roller 61 is brought into pressure contact with the pressure roller 54 with a high load and high contact pressure, a state illustrated in FIG. 5 where the heat accumulating roller 61 is brought into pressure contact with the pressure roller 54 with a light load and low contact pressure, and a state illustrated in FIG. 6 where the pressure roller 54 is separated from the heat accumulating roller 61.

In a case of the high load (high contact pressure) illustrated in FIG. 4, the nip amount between the pressure roller 54 and the heat accumulating roller 61 is increased. In a case of the high load (high contact pressure), the heat accumulation amount from the pressure roller 54 to the heat accumulating roller 61 is large, and an amount of the heat accumulated in the heat accumulating roller 61 to be transferred to the pressure roller 54 is increased. In a case of the light load (low contact pressure) illustrated in FIG. 5, the nip amount is decreased, the amount of the heat accumulated in the heat accumulating roller 61 to be transferred to the pressure roller 54 is small, and the amount of the heat accumulated in the heat accumulating roller 61 to be transferred to the pressure roller 54 is decreased. The state where the pressure roller 54 is separated from the heat accumulating roller 61 illustrated in FIG. 6 is set in the printing mode or when the heat is not transferred from the heat accumulating roller 61 to the pressure roller 54.

A detecting element 67*a* for home position detection is provided in the pressure contact/separation cam 62, and the detecting element 67*a* detects a home position by a home detection sensor 67*b* including a photo sensor. In the present embodiment, the state where the pressure roller 54 is separated from the heat accumulating roller 61 in FIG. 6 is set as the home position.

An encoder 68*a* is provided at one end of the shaft 62*b* to which the pressure contact/separation cam 62 is attached, and a pulse detection sensor 68 detects the rotation of the encoder 68*a*. The controller 100 controls the DC motor 69 to be positioned at the position of the light load or the high load according to the number of pulses output from the pulse detection sensor 68. That is, the controller 100 controls the driving of the DC motor 69 according to the home position and the output of the pulse detection sensor 68, and rotates the pressure contact/separation cam 62 so as to be positioned at the position of the high load (high contact pressure) illustrated in FIG. 4 or the position of the light load (low contact pressure) in FIG. 5.

In a case of the high load (high contact pressure) illustrated in FIG. 4, the pressure contact/separation cam 62 is moved to a position where a biasing force of the tension spring 65 between the pressure roller 54 and the heat accumulating roller 61 becomes the largest. In a case of the light load (low contact pressure) illustrated in FIG. 5, the pressure contact/separation cam 62 is moved to a position where the heat accumulating roller 61 is moved to be slightly separated from the pressure roller 54 against the biasing force of the tension spring 65. In a case of the separated state illustrated in FIG. 6, the pressure contact/separation cam 62 is moved to a position where the heat accumulating roller 61 is moved to be completely separated from the pressure roller 54 against the biasing force of the tension spring 65.

Figure 8:
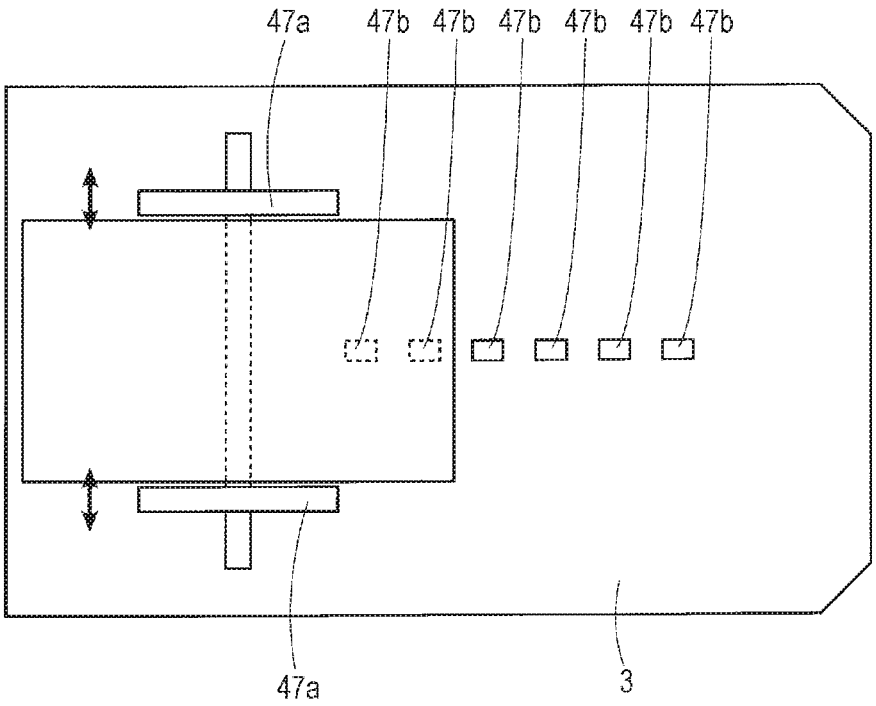
FIG. 8 is a schematic explanatory diagram of a manual feed tray portion used for the image forming apparatus according to the embodiment of the present invention.

As illustrated in FIG. 8, the manual feed tray 3 includes paper guides 47*a* and sensors 47*b* as paper size detectors 110. By the positions of the paper guides 47*a* and outputs from the sensors 47*b*, the size of the film setting sheet SF placed on the manual feed tray 3 is detected.

Next, the configuration of the controller of the image forming apparatus according to the present invention will be described with reference to FIG. 9.

FIG. 9 is a block diagram of a relationship between the configuration of the controller 100 and main components to be controlled by the controller 100.

As illustrated in FIG. 9, the controller 100 includes a Central Processing Unit (CPU) 101, a timer 102, a Read Only Memory (ROM) 103, a Random Access Memory (RAM) 104, a nonvolatile memory 105, a communication interface (IF) 106, and the like.

The CPU 101 executes a program to control the image processor 10, the sheet feeding devices 30*a* and 30*b*, the paper size detector 110, the fixing device 5, the operation panel 107, and the like. Various programs to be executed by the CPU 101 are stored in the ROM 103. The RAM 104 is used as a work area when the CPU 101 executes the program. The nonvolatile memory 105 stores an accumulated value of the number of printed sheets, an elapsed time from start of warming-up, an idle rotation time determination table, and the like.

The communication interface 106 is an interface for connecting the controller 100 to a LAN such as a LAN card and a LAN board.

The CPU 101 displays, for example, a laminate mode button used to select the laminate mode on a liquid crystal display (not shown) of the operation panel 107. When the user has selected (touch) the laminate mode button, the CPU 101 makes the liquid crystal display display a laminate mode setting screen to select the size of the document to be laminated, a basis weight of the laminate film, and the like. The operation panel 107 functions as an acceptor for accepting a specified laminate mode and as a basis weight information acquisitor for acquiring information regarding the basis weight of the laminate film. In the present embodiment, a laminate processing condition includes the size of the laminate film and the basis weight of the laminate film. As will be described later, the contact pressure of the heat accumulating roller 61 with respect to the pressure roller 54 is selected corresponding to the laminate processing condition.

The user touches and selects the size and the basis weight of the document from the setting screen so that the CPU 101 acquires information of the size and the basis weight and stores the information in the RAM 104. The paper size detected by the paper size detector 110 is applied to the CPU 101 and stored in the RAM 104.

Furthermore, based on temperature information from the fixing side temperature sensor 56, the CPU 101 controls and adjusts the temperature of the fixing nip N to be a target fixing temperature by performing on/off control of power supply to the heater 55 (referred to as "temperature adjusting and controlling processing" below).

In the present embodiment, the system speed in a case where a print job is executed is 110 mm/sec, and the system speed in a case where a laminate processing job is executed is 55 mm/sec. It is assumed that a fixing nip pressure in the fixing device 5 be set to 500 N.

Next, the temperature adjusting and controlling processing will be described. In the temperature adjusting and controlling processing, when the print job is accepted, based on the temperature information from the fixing side temperature sensor 56, the CPU 101 performs on/off control of the power supply to the heater 55 so that the surface temperature of the fixing belt 52 reaches the target fixing temperature (for example, 170° C.).

On the other hand, when the laminate processing job is accepted, unlike the print job for heating the surface of the recording medium S where the toner image has been formed (surface on the side of fixing belt 52) and thermally fixing the image, it is necessary to heat the film setting sheet DF in which the printed recording medium D is sandwiched between the laminate films F1 and F2 from both sides, that is, the fixing belt 52 and the pressure roller 54. Therefore, the CPU 101 determines a preheating time (idle rotation time) for preheating the pressure roller 54 with the heat from the fixing belt 52 so that the surface temperature of the fixing belt 52 reaches a predetermined target fixing temperature and a warming degree (heat accumulation state) of the pressure roller 54 suitable for performing the laminate processing job.

Since the film setting sheet DF has a heat capacity higher than that of the recording medium S, the heat quantity absorbed from the fixing belt 52 and the pressure roller 54 at the time of sheet feeding increases accordingly. Therefore, when the sheet is fed, a difference between temperatures of the fixing belt 52 heated by the heater 55 and the pressure roller 54 which does not have a heat source is increased, and a difference between expansion rates, caused by the heat, of the laminate film F1 of the fixing belt 52 and the laminate film F2 of the pressure roller 54 is increased. Therefore, a problem is caused such that wrinkles are generated in the bonded portion of the laminate films.

Therefore, in the present embodiment, to prevent the generation of the wrinkles in the bonded portion of the laminate films, the pressure contact state between the heat accumulating roller 61 and the pressure roller 54 is controlled so that the pressure roller 54 is sufficiently heated in advance to make an excellent heat accumulation state and the heat accumulating roller 61 brought into pressure contact with the pressure roller 54 accumulates the heat. In this way, by making the excellent heat accumulation state of the pressure roller 54 and accumulating the heat in the heat accumulating roller 61, the heat accumulated in the heat accumulating roller 61 is applied to the pressure roller 54 at the time of laminate processing, and a decrease in the temperature of the pressure roller 54 when the film setting sheet DF is fed is prevented. Accordingly, a difference between the expansion rates of the front and back laminate films F1 and F2 caused by the difference between the temperatures of the fixing belt 52 and the pressure roller 54 is prevented.

The controller 100 estimates the warming degree (heat accumulation state) of the pressure roller 54 and the heat accumulation state of the heat accumulating roller 61 based on the surface temperature of the pressure roller 54 detected by the pressure side temperature sensor 57 and the like.

The controller 100 controls the pressure contact/separation between the heat accumulating roller 61 and the pressure roller 54 according to the print job and the laminate processing job. Therefore, with the output from the home detection sensor 67*b*, the drive of the DC motor 69 as a pressure contact mechanism driving source is controlled so that the pressure roller 54 and the heat accumulating roller 61 are positioned at the home positions. Then, the controller 100 controls the drive of the DC motor 69 according to the output of the pulse detection sensor 68 and controls the pressure roller 54 and the heat accumulating roller 61 to be in the state of the high load (high contact pressure) or the light load (low contact pressure).

Next, an operation of the laminate processing performed by the controller 100 will be described with reference to a processing flowchart.

Figure 10:
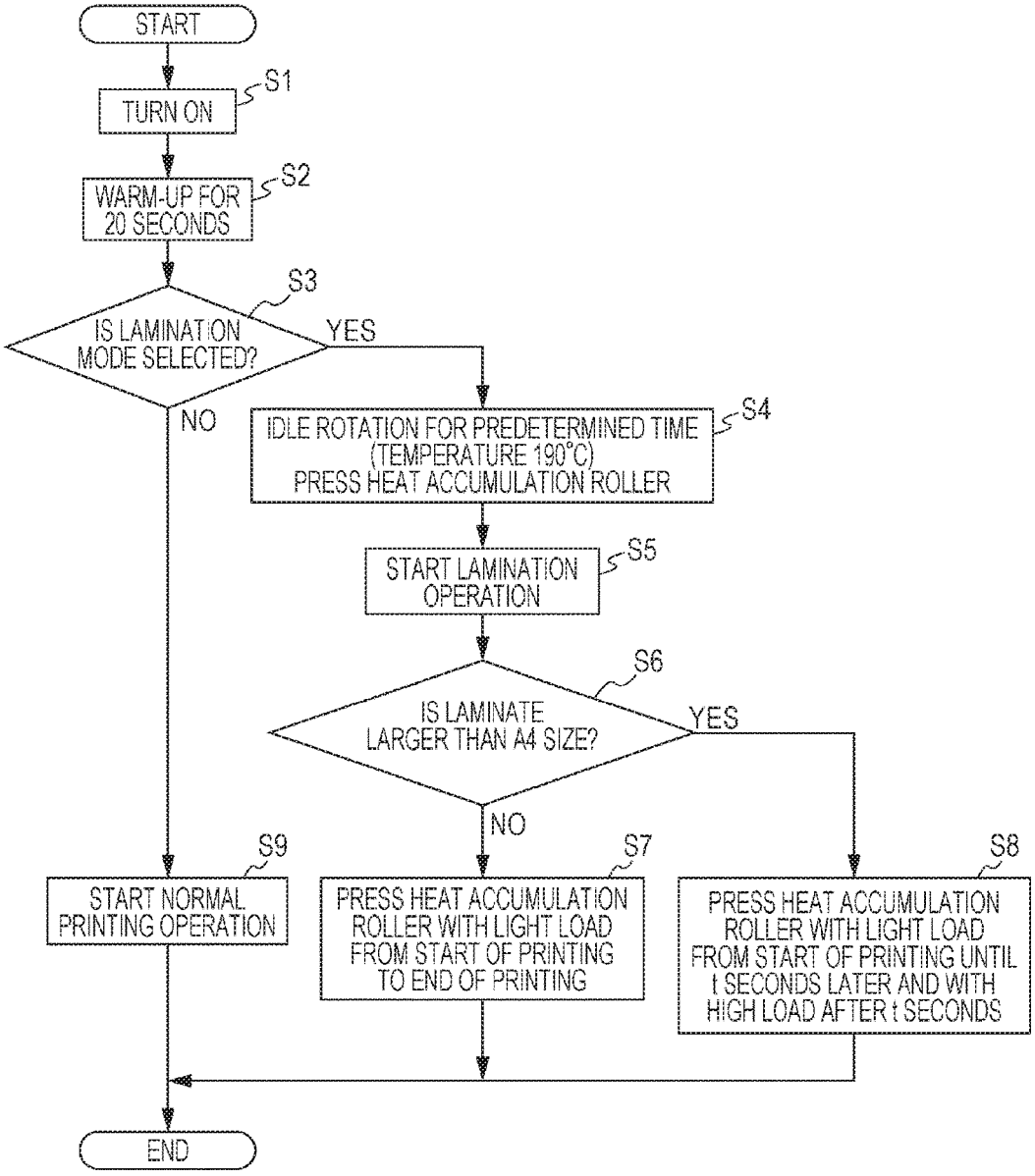
FIG. 10 is a processing flowchart of the controller, and an operation corresponding to the size of the laminate film is illustrated.

First, an operation of performing the laminate processing corresponding to the size of the laminate film as a laminate processing condition will be described with reference to the flowchart in FIG. 10.

First, when the image forming apparatus 1 is turned on (step S1), the controller 100 turns on the heater 55 to perform warm-up for increasing the surface temperature of the fixing belt 52 to the fixing temperature when the print job is executed (for example, 170° C.) for a predetermined time (step S2). After the start of the warm-up, while monitoring the detection result by the fixing side temperature sensor 56, the controller 100 continuously turns on the heater 55 and heats the fixing belt 52 until the surface temperature of the fixing belt 52 reaches 170° C. After the surface temperature has reached 170° C., the controller 100 performs on/off control of the heater 55 based on the detection result by the fixing side temperature sensor 56 to keep the surface temperature of the fixing belt 52 around 170° C. In the present embodiment, the warm-up for 20 seconds results in the fixing temperature at the time of executing the print job. To perform the warm-up, the timer 102 measures a time. When the warm-up for 20 seconds has been completed, the procedure proceeds to step S3.

Subsequently, in step S3, whether the job is accepted and the kind of the job are determined. As described above, in the present embodiment, since the job includes the print job and the laminate processing job, if the job is accepted in step S3, it is determined whether the job is the laminate processing job.

If the accepted job is not the laminate processing job, that is, in a case of the print job (step S3: NO), the procedure proceeds to step S9, and the controller 100 sets the system speed to 110 mm/sec and the target fixing temperature to 170° C., and performs on/off control to the heater 55 based on the detection result by the fixing side temperature sensor 56 so that the surface temperature of the fixing belt 52 becomes 170° C.

If the surface temperature of the fixing belt 52 has reached 170° C., the recording medium S is fed from the sheet feeding cassette 2 and the print job for forming an image on the recording medium S is executed (step S9).

On the other hand, if the accepted job is the laminate processing job (step S3: Yes), the controller 100 executes idle rotation processing in step S4 to sufficiently heat the pressure roller 54 and the heat accumulating roller 61 prior to the laminate operation.

In the idle rotation processing, first, the fixing temperature to be a control target of the fixing belt 52 (control target temperature) is set to 190° C., and the controller 100 starts to perform the control to continuously turn on the heater 55 and heats the fixing belt 52 until the surface temperature of the fixing belt 52 reaches 190° C. while monitoring the detection result by the fixing side temperature sensor 56.

After the temperature has reached 190° C., by performing the on/off control to the heater 55 based on the detection result by the fixing side temperature sensor 56, the surface temperature of the fixing belt 52 is kept around 190° C. Here, the temperature of 190° C. to be the control target temperature is the highest temperature within a range in which temperatures of components of the fixing device 5 are equal to or lower than a heatproof temperature and the temperature does not affect safety.

Concurrently with the processing of controlling the temperature of the fixing belt 52, the controller 100 rotates the pressure contact/separation cam 62 of the pressure contact/separation mechanism 6 so that the heat accumulating roller 61 is brought into pressure contact with the pressure roller 54 with the high load (high contact pressure). Then, the controller 100 determines the idle rotation processing time and executes the idle rotation processing of the fixing belt 52 for the determined time to preheat the pressure roller 54 and the heat accumulating roller 61.

To determine the idle rotation processing time, the idle rotation time determination table according to the size and the basis weight of the laminate film to be laminated is stored in the nonvolatile memory 105.

The controller 100 measures an elapsed time (seconds) from the start of the warm-up by the timer 102.

Since a contact time with the fixing belt 52 gets longer as the elapsed time from the start of the warm-up is longer, the heat quantity accumulated in the pressure roller 54 is increased. Then, a preheat time (idle rotation time) until a heat accumulation amount necessary for the laminate processing is obtained is shortened.

In addition, as a surface temperature Tp of the pressure roller 54 is higher, it can be inferred that the warm-up is started in a state where the heat accumulation amount of the pressure roller 54 is not decreased so much due to heat radiation after the mode is shifted from a previous standby mode to a sleep mode. After that, the preheat time until the heat accumulation amount necessary for the laminate processing is obtained is reduced.

That is, in a case where the control target fixing temperature of the fixing belt 52 is set to 190° C., the idle rotation time determination table is created by setting the elapsed time from the start of the warm-up and the surface temperature of the pressure roller 54 at a specific time as a parameter indicating the heat accumulation states of the pressure roller 54 and the heat accumulating roller 61 and obtaining the preheat time until the heat accumulation amount necessary for the laminate processing is obtained with respect to the parameter.

Normally, at the time of idle rotation, the heat accumulating roller 61 is brought into pressure contact with the pressure roller 54 with a high load (high contact pressure) to increase the amount of heat accumulated in the heat accumulating roller 61. As described above, the fixing device 5 determines the warming degree based on the surface temperature Tp of the member of the pressure roller 54. In a case where it is determined that the pressure roller 54 is warmed, a time necessary for accumulating the heat in the pressure roller 54 can be shortened by setting the contact pressure of the heat accumulating roller 61 to the light load (low contact pressure). Specifically, in a case where the temperature of the pressure roller 54 exceeds 140° C., the load of the contact pressure of the heat accumulating roller 61 is set to 20 N which is a light load.

When the basis weight of the laminate film is equal to or more than 100 g/m$^2$ and the size is equal to or larger than A4, both the size and the basis weight are disadvantageous with respect to lamination. Therefore, the idle rotation time is further increased 50% to 100% longer than the normal time. For example, when the normal idle rotation time in a case of the lamination from the state where the fixing device 5 is warmed is 30 seconds, the idle rotation time for 15 to 30 seconds is added, and the idle rotation time is 45 to 60 seconds.

The idle rotation time determined based on the size, the basis weight of the laminate film and temperature of the fixing device 5 is stored in the nonvolatile memory 105 as the idle rotation time determination table. The controller 100 measures the idle rotation time read from the nonvolatile memory 105 by the timer 102 and starts the laminate operation when the idle rotation time has elapsed (step S5).

When the laminate operation is started, the controller 100 determines whether the laminate film is larger than A4 by the output from the paper size detector 110 (step S6).

During the laminate operation, it is desirable to maintain the temperatures of the fixing belt 52, the fixing roller 53 and the pressure roller 54 at the temperature of 190° C. throughout the paper feeding. At the time of lamination, the pressure roller 54 without the heat supply source needs a heat capacity equal to or more than that at the time of fixing operation in the normal printing mode. Therefore, the heat accumulating roller 61 is brought into pressure contact with the pressure roller 54 from idle rotation to completion of the lamination.

In a case where the size of the laminate film is equal to or smaller than A4 (step S6: No), the heat accumulating roller 61 is brought into pressure contact with the pressure roller 54 with a light load (low contact pressure) from the start to the completion of the printing, and the laminate is fixed while supplying the heat to the pressure roller 54 (step S7). Then, the operation is terminated. When the laminate processing is terminated, the heat accumulating roller 61 is separated from the pressure roller 54.

When the size of the laminate film is larger than A4 (step S6: Yes), the heat accumulating roller 61 is brought into pressure contact with the pressure roller 54 with a light load (low contact pressure) from the start of printing until a predetermined time t seconds later. After t seconds, the heat accumulating roller 61 is continuously brought into pressure contact with the pressure roller 54 until the end of printing as changing the contact pressure to a high load (high contact pressure). Then, the laminate is fixed while supplying the heat to the pressure roller 54 (step S7), and the operation is terminated. When the laminate processing is terminated, the heat accumulating roller 61 is separated from the pressure roller 54.

Here, t seconds is, for example, a time to rotate the pressure roller 54 one round at the time of laminate mode. The t seconds is 1.7 seconds in a case where the system speed is 55 mm/sec and an outer diameter of the pressure roller 54 is 30 mm. Furthermore, as described above, the high load is 70 N in total, and the light load is 20 N.

Figure 11:
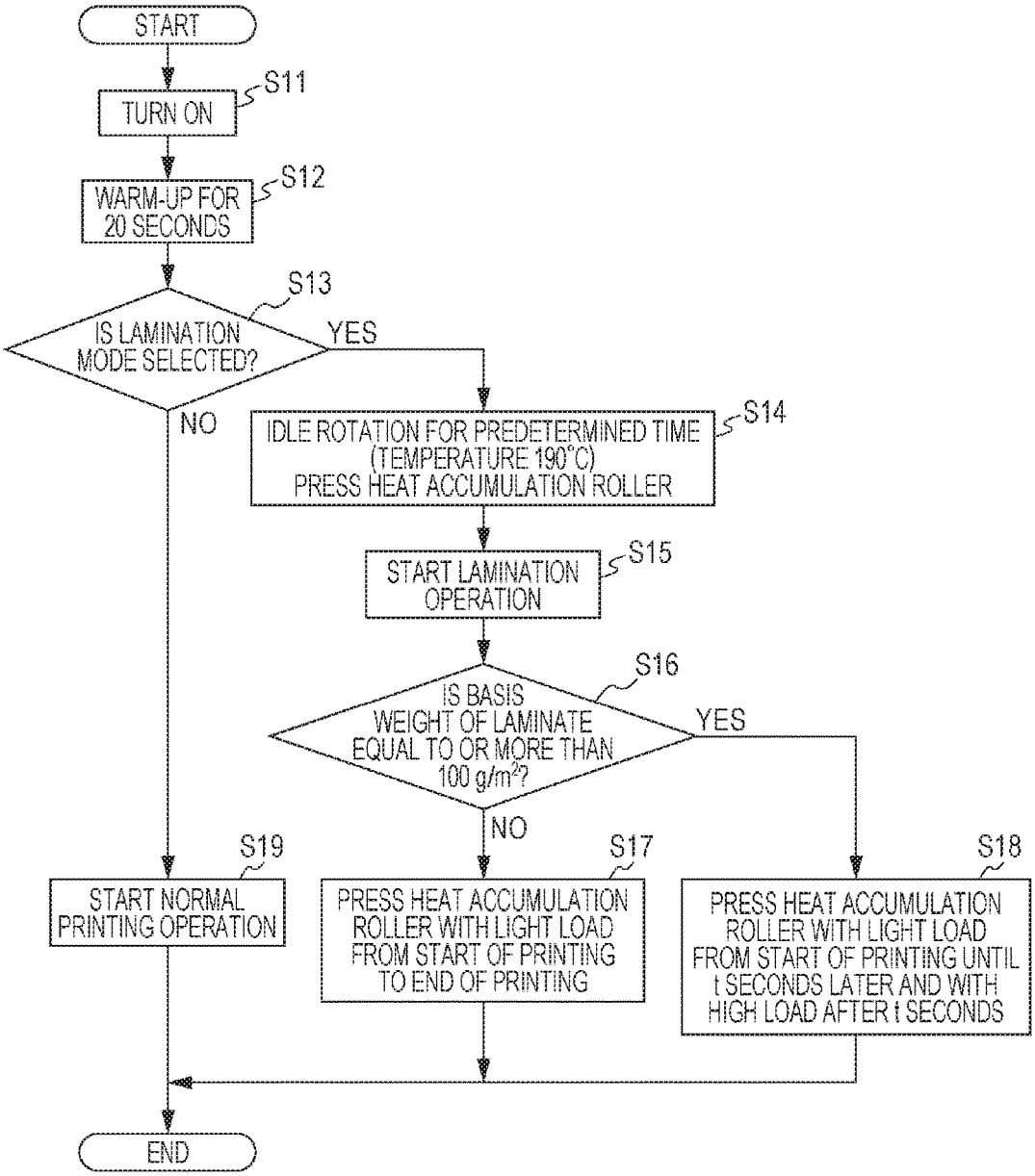
FIG. 11 is a processing flowchart of the controller, and an operation corresponding to the basis weight of the laminate film is illustrated.

Next, an operation of performing the laminate processing corresponding to the basis weight of the laminate film as a laminate processing condition will be described with reference to the processing flowchart in FIG. 11.

First, when the image forming apparatus 1 is turned on (step S11), the controller 100 turns on the heater 55 to perform warm-up for increasing the surface temperature of the fixing belt 52 to the fixing temperature when the print job is executed (for example, 170° C.) for a predetermined time (for 20 seconds) (step S12).

Subsequently, in step S13, whether the job is accepted and the kind of the job are determined. As described above, in the present embodiment, since the job includes the print job and the laminate processing job, if the job is accepted in step S13, it is determined whether the job is the laminate processing job.

If the accepted job is not the laminate processing job, that is, in a case of the print job (step S13: NO), the procedure proceeds to step S19, and the controller 100 sets the system speed to 110 mm/sec and the target fixing temperature to 170° C., feeds the recording medium S from the sheet feeding cassette 2, and executes the print job for forming the image on the recording medium S (step S19).

On the other hand, if the accepted job is the laminate processing job (step S13: Yes), the controller 100 executes idle rotation processing in step S14 to sufficiently heat the pressure roller 54 and the heat accumulating roller 61 prior to the laminate operation.

In the idle rotation processing, first, the fixing temperature to be a control target of the fixing belt 52 (control target temperature) is set to 190° C., and the controller 100 starts to perform the control to continuously turn on the heater 55 and heats the fixing belt 52 until the surface temperature of the fixing belt 52 reaches 190° C. while monitoring the detection result by the fixing side temperature sensor 56. Concurrently with the processing of controlling the temperature of the fixing belt 52, the controller 100 rotates the pressure contact/separation cam 62 of the pressure contact/separation mechanism 6 so that the heat accumulating roller 61 is brought into pressure contact with the pressure roller 54 with the high load. Then, the controller 100 determines the idle rotation processing time and executes the idle rotation processing of the fixing belt 52 for the determined time to preheat the pressure roller 54 and the heat accumulating roller 61. When the idle rotation time has elapsed, the laminate operation is started (step S15).

When starting the laminate operation, the controller 100 reads the basis weight applied from the basis weight information acquisitor from the RAM 104 and determines whether the basis weight of the laminate film is equal to or more than 100 g/m$^2$ (step S16).

In a case where the basis weight of the laminate film is smaller than 100 g/m$^2$ (step S16: No), the heat accumulating roller 61 is brought into pressure contact with the pressure roller 54 with a light load (low contact pressure) from the start to the completion of the printing, and the laminate is fixed while supplying the heat to the pressure roller 54 (step S17). Then, the operation is terminated. When the laminate processing is terminated, the heat accumulating roller 61 is separated from the pressure roller 54.

When the basis weight of the laminate film is equal to or larger than 100 g/m$^2$ (step S16: Yes), the heat accumulating roller 61 is brought into pressure contact with the pressure roller 54 with a light load (low contact pressure) from the start of printing until a predetermined time t seconds later (step S18). After t seconds, the heat accumulating roller 61 is continuously brought into pressure contact with the pressure roller 54 until the end of printing as changing the contact pressure to a high load (high contact pressure) (step S18). Then, the laminate is fixed while supplying the heat to the pressure roller 54 (step S17), and the operation is terminated. When the laminate processing is terminated, the heat accumulating roller 61 is separated from the pressure roller 54.

Here, similarly to the above description, t seconds is, for example, a time to rotate the pressure roller 54 one round at the time of laminate mode. The t seconds is 1.7 seconds in a case where the system speed is 55 mm/sec and the outer diameter of the pressure roller 54 is 30 mm. Furthermore, as described above, the high load is 70 N in total, and the light load is 20 N.

Next, an operation of performing the laminate processing corresponding to both information of the size and the basis weight of the laminate film as laminate processing conditions will be described with reference to the processing flowchart in FIG. 12.

First, when the image forming apparatus 1 is turned on (step S21), the controller 100 turns on the heater 55 to perform warm-up for increasing the surface temperature of the fixing belt 52 to the fixing temperature when the print job is executed (for example, 170° C.) for a predetermined time (for 20 seconds) (step S22).

Subsequently, in step S23, whether the job is accepted and the kind of the job are determined. As described above, in the present embodiment, since the job includes the print job and the laminate processing job, if the job is accepted in step S23, it is determined whether the job is the laminate processing job.

If the accepted job is not the laminate processing job, that is, in a case of the print job (step S23: NO), the procedure proceeds to step S34, and the controller 100 sets the system speed to 110 mm/sec and the target fixing temperature to 170° C., feeds the recording medium S from the sheet feeding cassette 2, and executes the print job for forming the image on the recording medium S (step S34).

On the other hand, if the accepted job is the laminate processing job (step S23: Yes), the controller 100 executes idle rotation processing in step S24 to sufficiently preheat the pressure roller 54 and the heat accumulating roller 61 prior to the laminate operation.

Then, the controller 100 executes the idle rotation processing of the fixing belt 52 for the determined idle rotation processing time to preheat the pressure roller 54 and the heat accumulating roller 61. When the idle rotation time has elapsed, the laminate operation is started (step S25).

When starting the laminate operation, the controller 100 reads the basis weight from the RAM 104 and determines whether the basis weight of the laminate film is equal to or more than 100 g/m$^2$ (step S26).

In a case where the basis weight of the laminate film is smaller than 100 g/m$^2$ (step S26: No), the controller 100 determines whether the laminate film is larger than A4 by the output from the paper size detector 110 (step S27).

In a case where the size of the laminate film is equal to or smaller than A4 (step S27: No), the heat accumulating roller 61 is brought into pressure contact with the pressure roller 54 with a light load (low contact pressure) from the start to the completion of the printing, and the laminate is fixed while supplying the heat to the pressure roller 54 (step S28). Then, the operation is terminated. When the laminate processing is terminated, the heat accumulating roller 61 is separated from the pressure roller 54.

When the size of the laminate film is larger than A4 (step S27: Yes), the heat accumulating roller 61 is brought into pressure contact with the pressure roller 54 with a light load (low contact pressure) from the start of printing until a predetermined time t1 seconds later. After t1 seconds, the heat accumulating roller 61 is continuously brought into pressure contact with the pressure roller 54 until the end of printing as changing the contact pressure to a high load (high contact pressure). Then, the laminate is fixed while supplying the heat to the pressure roller 54 (step S29), and the operation is terminated. When the laminate processing is terminated, the heat accumulating roller 61 is separated from the pressure roller 54.

In a case where the basis weight of the laminate film is equal to or more than 100 g/m$^2$ (step S26: Yes), the controller 100 determines whether the laminate film is larger than A4 by the output from the paper size detector 110 (step S30).

When the size of the laminate film is equal to or smaller than A4 (step S30: No), the heat accumulating roller 61 is brought into pressure contact with the pressure roller 54 with a light load (low contact pressure) from the start of printing until a predetermined time t1 seconds later. After t1 seconds, the heat accumulating roller 61 is continuously brought into pressure contact with the pressure roller 54 until the end of printing as changing the contact pressure to a high load (high contact pressure). Then, the laminate is fixed while supplying the heat to the pressure roller 54 (step S32), and the operation is terminated. When the laminate processing is terminated, the heat accumulating roller 61 is separated from the pressure roller 54.

If it is determined in step S30 that the laminate film is larger than A4, the idle rotation time is extended for t3 seconds (step S31). When the basis weight is equal to or more than 100 g/m$^2$ and the laminate size is equal to or more than A4, since both size and basis weight are disadvantageous for laminate fixing, the idle rotation is extended for t3 seconds than usual. The idle rotation time to be added is the time of 50% to 100% of the normal idle rotation time. If the normal idle rotation time is 30 seconds, t3 seconds mean 15 to 30 seconds. After extending the idle rotation, no load is applied between the heat accumulating roller 61 and the pressure roller 54, that is, the heat accumulating roller 61 is separated from the pressure roller 54 from the start of printing until a predetermined time t1 seconds elapses, and the heat accumulating roller 61 is brought into pressure contact with the pressure roller 54 with the light load (low contact pressure) from t1 seconds later to t2 seconds later. After t2 seconds later, pressure contact is continued until the end of printing as changing the contact pressure in stages so that the heat accumulating roller 61 is brought into pressure contact with the pressure roller 54 with the high load (high contact pressure). Then, the laminate is fixed while supplying the heat to the pressure roller 54 (step S33), and the operation is terminated. When the laminate processing is terminated, the heat accumulating roller 61 is separated from the pressure roller 54.

For example, t1 seconds is, for example, a time to rotate the pressure roller 54 one round at the time of laminate mode. The t seconds is 1.7 seconds in a case where the system speed is 55 mm/sec and an outer diameter of the pressure roller 54 is 30 mm. the time t2 of the pressure roller 54 is a time to rotate the pressure roller 54 two rounds which is 3.4 seconds. Furthermore, as described above, the high load is 70 N in total, and the light load is 20 N.

In the processing in FIG. 12 described above, the basis weight of the laminate film has been previously determined. However, the size of the laminate film may be previously determined, and either one may be determined first.

In the embodiment described above, an example in which the present invention is applied to a so-called tandem type color image forming apparatus as the image forming apparatus 1 is indicated. However, the present invention is not limited to the application to this type of image forming apparatus. For example, the present invention can be applied to a so-called four-cycle system image forming apparatus which has four developing devices around a rotation shaft and obtains a full color image by sequentially facing the developing devices to an electrostatic latent image carrier or a monochrome image forming apparatus having only one developing device. The intermediate transfer belt has been used as an image carrier. However, the image carrier is not limited to this, and the present invention can be applied to the one which transfers a toner image formed on the surface of the photoreceptor to the recording medium by a transfer roller.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a fixing device that forms a fixing nip by bringing a pressure member having a release layer and an elastic layer on a surface into pressure contact with a peripheral surface of a heating rotator and fixes an unfixed toner image by feeding a recording medium having the unfixed toner image through the fixing nip;

an acceptor that accepts a specified laminate processing mode for performing laminate processing by feeding a laminate in which laminate films are laminated on both surfaces of the recording medium through the fixing nip; and a hardware processor that controls the heating rotator to idle for a predetermined time without feeding a sheet while the fixing nip is formed when the laminate processing mode is accepted, and then, controls to perform the laminate processing, wherein a heat accumulating member provided to be capable of contacting with and separating from an outer peripheral surface of the pressure member and a pressure contact/separation mechanism which makes the heat accumulating member have contact with or be separated from the pressure member are further included, and when accepting the laminate processing mode, the hardware processor performs control to idle the heating rotator for a predetermined time in a state where the heat accumulating member is brought into pressure contact with the pressure member by the pressure contact/separation mechanism to accumulate heat in the heat accumulating member.

2. The image forming apparatus according to claim 1, wherein the pressure contact/separation mechanism operates to change a contact pressure of the heat accumulating member to the pressure member and changes the contact pressure of the heat accumulating member to the pressure member corresponding to a laminate processing condition.

3. The image forming apparatus according to claim 1, wherein the pressure member is a foam elastic roller.

4. The image forming apparatus according to claim 1, wherein the heat accumulating member is a metal roller.

5. The image forming apparatus according to claim 1, wherein the hardware processor performs control so that the heat accumulating member is brought into pressure contact with the pressure member based on a start of the laminate processing and is separated from the pressure member based on an end of the laminate processing.

6. The image forming apparatus according to claim 1, further comprising:

a size detector that detects a size of the laminate films, wherein based on information of the size detector, the hardware processor controls an operation of the pressure contact/separation mechanism and controls a pressure contact time or a contact pressure of the heat accumulating member to the pressure member at the time of laminate processing.

7. The image forming apparatus according to claim 6, wherein based on the information of the size detector, when determined that a laminate film having a size equal to or larger than a predetermined size has been set, the hardware processor controls the operation of the pressure contact/separation mechanism so that the heat accumulating member is brought into contact with the pressure member without a contact pressure or a low contact pressure in a first half of a time when the laminate film is fed and that the heat accumulating member is brought into contact with the pressure member with a high contact pressure in a latter half of the time when the laminate film is fed.

8. The image forming apparatus according to claim 6, wherein based on the information of the size detector, when determined that a laminate film having a size equal to or larger than a predetermined size has been set, the hardware processor controls the operation of the pressure contact/separation mechanism so that the heat accumulating member is brought into contact with the pressure member without a contact pressure or the heat accumulating member is brought into contact with the pressure member as setting the contact pressure from a low contact pressure to a high contact pressure in stages from a first half to a latter half of a time when the laminate film is fed.

9. The image forming apparatus according to claim 6, wherein the pressure member is an elastic roller, and based on the information of the size detector, when determined that a laminate film having a size equal to or larger than a predetermined size has been set, the hardware processor controls an operation of the pressure contact/separation mechanism so that a contact pressure of the heat accumulating member to the pressure member at the time of laminate processing is increased according to the number of rotations of the elastic roller.

10. The image forming apparatus according to claim 1, further comprising:

a basis weight information acquisitor that acquires information on a basis weight of the laminate films, wherein based on the information of the basis weight information acquisitor, the hardware processor controls the pressure contact/separation mechanism and controls a pressure contact time or a contact pressure of the heat accumulating member to the pressure member at the time of laminate processing.

11. The image forming apparatus according to claim 10, wherein based on the information of the basis weight information acquisitor, when determined that a laminate film having a basis weight equal to or more than a predetermined basis weight has been set, the hardware processor controls the operation of the pressure contact/separation mechanism so that the heat accumulating member is brought into contact with the pressure member without a contact pressure or a low contact pressure in a first half of a time when the laminate film is fed and that the heat accumulating member is brought into contact with the pressure member with a high contact pressure in a latter half of the time when the laminate film is fed.

12. The image forming apparatus according to claim 10, wherein based on the information of the basis weight information acquisitor, when determined that a laminate film having a basis weight equal to or more than a predetermined basis weight has been set, the hardware processor controls the operation of the pressure contact/separation mechanism so that the heat accumulating member is brought into contact with the pressure member without a contact pressure or the heat accumulating member is brought into contact with the pressure member as setting the contact pressure from a low contact pressure to a high contact pressure in stages from a first half to a latter half of a time when the laminate film is fed.

13. The image forming apparatus according to claim 10, wherein the pressure member is an elastic roller, and based on the information of the basis weight information acquisitor, when determined that a laminate film having a basis weight equal to or more than a predetermined basis weight has been set, the hardware processor controls an operation of the pressure contact/separation mechanism so that a contact pressure of the heat accumulating member to the pressure member at the time of laminate processing is increased according to the number of rotations of the elastic roller.

14. The image forming apparatus according to claim 1, further comprising:

a measurer that measures an elapsed time from start of warm-up;

a temperature acquisitor that acquires a surface temperature of at least one of the heating rotator and the pressure member; and a determiner that determines a time to execute idle rotation processing for rotating the heating rotator without feeding a sheet while the fixing nip is formed, wherein the determiner determines the time to execute the idle rotation processing according to the elapsed time from the start of warm-up and the surface temperature acquired by the temperature acquisitor, and the hardware processor sets a contact pressure of the heat accumulating member to the pressure member according to the elapsed time from the start of warm-up and the surface temperature acquired by the temperature acquisitor.

* * * * *